US007183904B2

(12) United States Patent
Katsuragawa et al.

(10) Patent No.: US 7,183,904 B2
(45) Date of Patent: Feb. 27, 2007

(54) ENGINE OUTPUT CONDITION INFORMING SYSTEM FOR SNOW REMOVER

(75) Inventors: Shinichi Katsuragawa, Saitama (JP); Hayato Matsuda, Saitama (JP); Tomoki Fukushima, Saitama (JP)

(73) Assignee: Honda Motor Co., Ltd, Tokyo (JP)

( * ) Notice: Subject to any disclaimer, the term of this patent is extended or adjusted under 35 U.S.C. 154(b) by 157 days.

(21) Appl. No.: 11/036,398

(22) Filed: Jan. 14, 2005

(65) Prior Publication Data

US 2005/0154521 A1 Jul. 14, 2005

(30) Foreign Application Priority Data

Jan. 14, 2004 (JP) ..... 2004-007381

(51) Int. Cl.
*B60Q 1/00* (2006.01)

(52) U.S. Cl. ..... 340/439; 701/101

(58) Field of Classification Search ..... 340/439, 340/441; 701/101

See application file for complete search history.

(56) References Cited

U.S. PATENT DOCUMENTS 4,623,870 A * 11/1986 Irimajiri et al. ..... 340/439
4,940,030 A * 7/1990 Morikawa ..... 123/198 D
5,050,080 A * 9/1991 Abe ..... 340/439
5,758,299 A * 5/1998 Sandborg et al. ..... 340/439
6,094,617 A * 7/2000 Lapke ..... 340/439
6,347,269 B1 * 2/2002 Hayakawa et al. ..... 701/51
6,920,387 B2 * 7/2005 Landes et al. ..... 701/102
7,085,645 B2 * 8/2006 Matsuda et al. ..... 701/110

FOREIGN PATENT DOCUMENTS

JP 59-42941 3/1984
JP 2001-020238 1/2001

* cited by examiner

*Primary Examiner*—Thomas Mullen
(74) *Attorney, Agent, or Firm*—Carrier, Blackman & Associates, P.C.; Joseph P. Carrier; William D. Blackman

(57) ABSTRACT

In an engine output condition informing system for a snow remover, the engine speed and the throttle position are detected, the output power rate OPrate of the engine is estimated based thereon, the output power condition of the engine is determined based on the estimated output power rate, and the operator is informed of the determined output power condition by the display (informing) device. With this, the output power condition of the engine can be accurately determined and the operator informed with a simple configuration, whereby the burden on the operator can be lightened. Also, it is possible to minimize situations in which the output power condition of the engine is overpowered and the power train of the engine or of the snow removal mechanism and travel mechanism is damaged, as well as situations in which the output power condition of the engine becomes underpowered, the snow remover is unable to perform, and the operating efficiency decreases.

8 Claims, 5 Drawing Sheets

ENGINE OUTPUT CONDITION INFORMING SYSTEM FOR SNOW REMOVER

BACKGROUND OF THE INVENTION

1. Field of the Invention

The present invention relates to an engine output condition informing system for a snow remover.

2. Description of the Related Art

Widely known in conventional practice are snow removers in which an internal combustion engine is mounted, a snow removal mechanism (such as auger or blower) is driven with the engine, and a travel mechanism (such as crawler) is also driven by the engine to allow the snow remover to be self-propelled, for example, as taught in Japanese Laid-Open Patent Application No. 2001-20238.

In conventional practice, when a snow remover that drives the mechanisms by the engine output power is used, the operator experimentially determines the magnitude of the engine output power (i.e., load) on the basis of fluctuations in the engine noise or speed, and adjusts the operation of the snow removal mechanism or the travel mechanism so as not to deviate from the rated output power.

Aside from the above, for internal combustion engines installed in four-wheeled vehicles, a widely known art is one wherein the axial torque is detected from the twisting of the propeller shaft in the engine side and differential gear side, and the engine output is calculated based on the detected axial torque. Also proposed is an art wherein the axial torque is calculated based on the combustion pressure and speed of the engine, the oil temperature, and some similar parameters, as described in Japanese Utility Model Publication No. Hei 3(1991)-4922.

As described above, conventional snow removers have been inconvenient in that a large burden is imposed on the operator, since the operator must experientially determine the magnitude of the engine output power from fluctuations in the engine noise or speed. Since this approach relies on the operator's experience, it is not necessarily possible to accurately determine whether the engine output is within the range of the rated power, and there is a possibility that the engine will be overpowered, incurring damage in the power train, or that the output will fall below the rated power, inducing a decrease in operating efficiency.

Another possibility with determining the engine output condition is to utilize the detected or calculated engine output power or torque by the art relating to four-wheeled vehicles described above. However, this prior art has been inconvenient due to complicated configurations.

SUMMARY OF THE INVENTION

Therefore, an object of the present invention is to solve the problems described above and to provide an engine output condition informing system for a snow remover that is configured to accurately determine the engine output condition and inform the operator with a simple configuration, thereby reducing the burden on the operator, reducing the damage to the engine or power train, and minimizing the reduction in operating efficiency.

In order to achieve the object, there is provided a system for informing output condition of an internal combustion engine mounted on a snow remover having a snow removal mechanism and a travel mechanism such that at least one of the snow removal mechanism and travel mechanism is driven by the engine in response to an instruction of an operator, comprising: an engine speed sensor detecting speed of the engine; a throttle position sensor detecting position of a throttle valve of the engine; an engine output power rate estimator estimating an engine output power rate based on the detected speed of the engine and position of the throttle valve; an engine output condition determiner determining output condition of the engine based on the estimated engine output power rate; and an informing device informing the determined output condition of the engine to the operator.

BRIEF DESCRIPTION OF THE DRAWINGS

The above and other objects and advantages of the invention will be more apparent from the following description and drawings, in which.

DESCRIPTION OF THE PREFERRED EMBODIMENT

The preferred embodiment of the engine output condition informing system for a snow remover according to the present invention will now be described with reference to the accompanying drawings.

Figure 1:
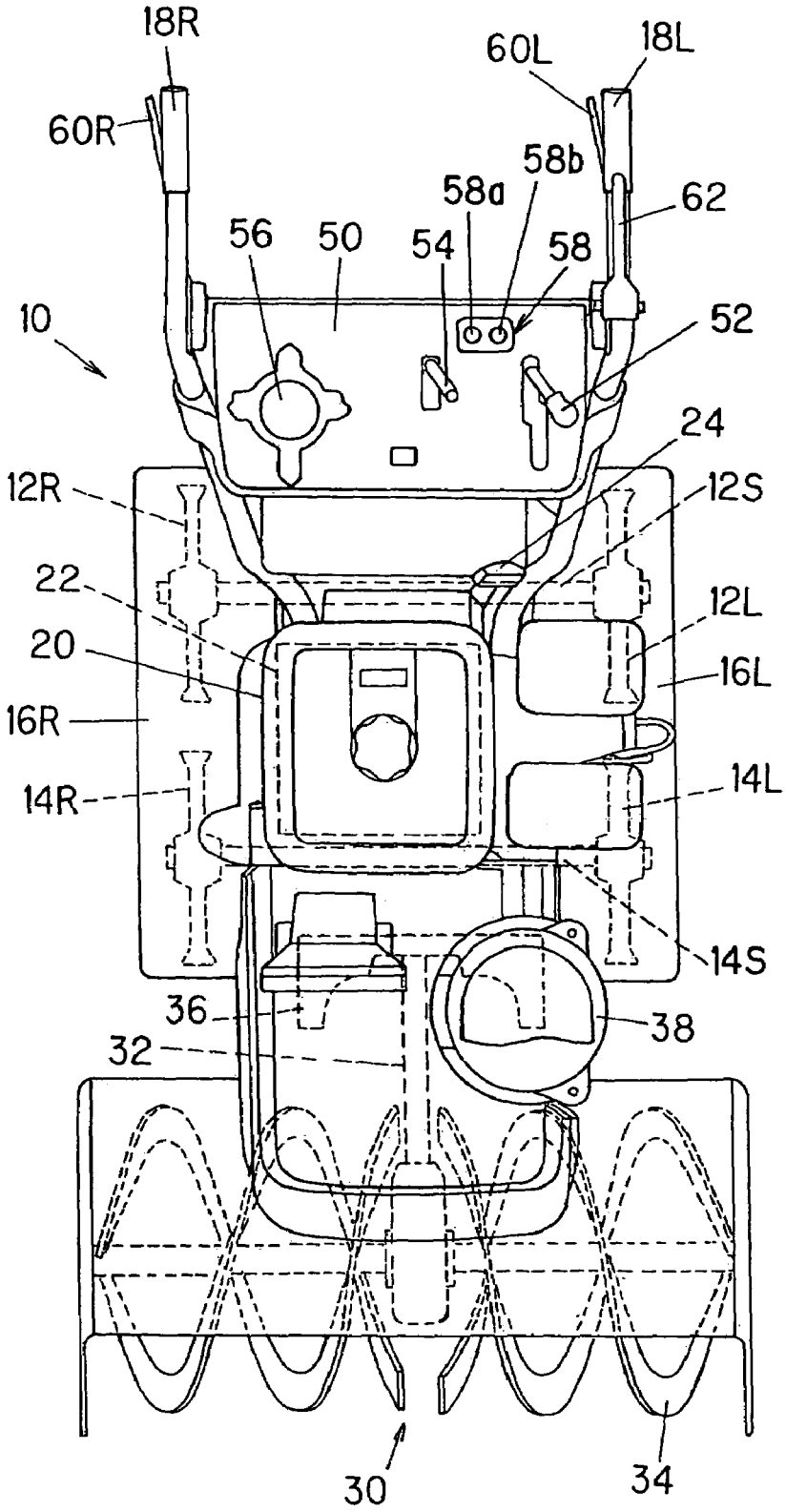
FIG. 1 is a plan view of a snow remover equipped with engine output condition informing system for a snow remover according to an embodiment of the present invention.
Figure 2:
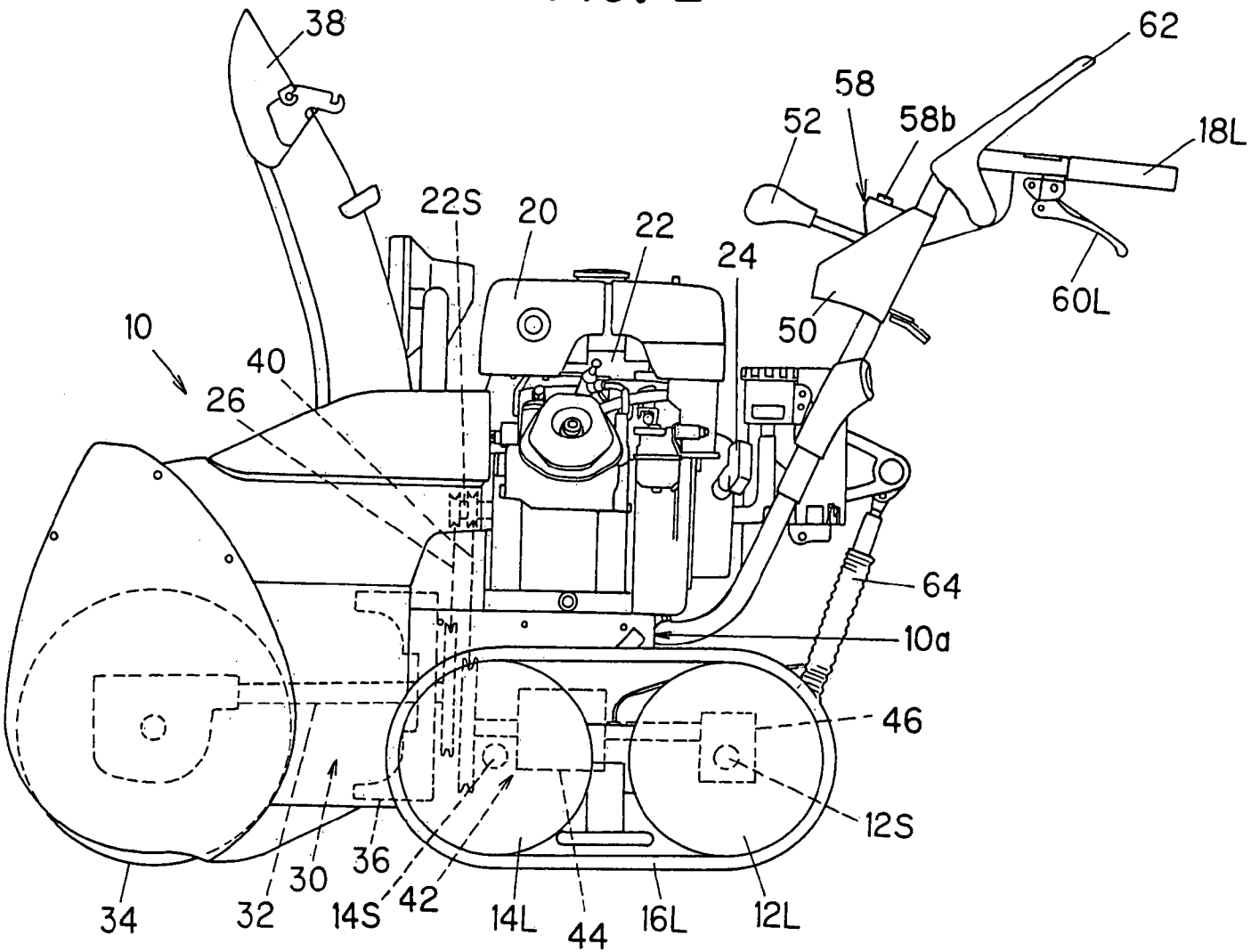
FIG. 2 is a left hand side view of the snow remover shown in FIG. 1.

FIG. 1 is a plan view of a snow remover equipped with the engine output condition informing system for a snow remover according to the present embodiment. FIG. 2 is a left hand side view of the snow remover shown in FIG. 1.

In FIGS. 1 and 2, reference numeral 10 indicates a snow remover. The snow remover 10 is a non-riding self-propelled snow remover that has a pair of crawlers 16L and 16R wrapped around left and right (in the direction of movement) driving wheels (rear wheels) 12L and 12R and driven wheels (front wheels) 14L and 14R, and a pair of handlebars 18L and 18R.

An internal combustion engine 22 is mounted in the interior of an engine cover 20 on top of a body frame 10*a* of the snow remover 10. The engine 22 has a recoil starter 24, and is manually started by the operator.

A crankshaft 22S of the engine 22 is connected to a snow removal mechanism 30 provided near the distal end of the body frame 10*a* via a first belt 26 wound around a pulley, as shown in FIG. 2. The snow removal mechanism 30 has a rotating shaft 32 to which the rotational output of the engine 22 is transmitted by the first belt 26, and an auger 34 and a blower 36 attached to the rotating shaft 32. A shooter 38 is provided above the blower 36.

The crankshaft 22S of the engine 22 is also connected to a travel mechanism 42 via a second belt 40 wound around a pulley. The travel mechanism 42 has a transmission 44 to which the rotational output of the engine 22 is transmitted by the second belt 40, a differential mechanism 46 connected to the transmission 44, driving wheels 12L and 12R connected to the differential mechanism 46 via an axle 12S, driven wheels 14L and 14R, and crawlers 16L and 16R. The axle 12S of the driving wheels 12L and 12R and the axle 14S of the driven wheels 14L and 14R are rotatably supported by a travel frame (not shown).

An operating panel 50 is provided between the left and right handlebars 18L and 18R. The operating panel 50 has a speed control lever 52, an auger height control lever 54, a shooter direction control lever 56, and a display (informing) device 58. The display device 58 includes a rated-power display light 58*a* and an overpower display light 58*b*. Turning levers 60L and 60R are provided below the left and right handlebars 18L and 18R, and a travel lever 62 is provided above the left handlebar 18L.

Next, the travel operation and snow removal operation of the snow remover 10 will be briefly described.

When the operator grasps the travel lever 62, a deadman clutch (not shown) disposed in the middle of the power transmission path of the travel mechanism 42 begins transmitting power, whereby the rotational output of the engine 22 is transmitted to the crawlers 16L and 16R and the snow remover 10 begins to move. As a result of operating the speed control lever 52, the transmission ratio (gear ratio) of the transmission 44 varies, or the throttle valve of the engine 22 is opened or closed by an electric motor (described later) to vary the engine speed, whereby the travel speed of the snow remover 10 is adjusted.

Furthermore, grasping either of the left and right turning levers 60L and 60R causes a braking mechanism (not shown) to operate and reduce the rotating speed of the corresponding crawler, whereby the snow remover 10 is turned.

The auger 34 is driven by the rotational output of the engine 22, whereby snow in front of the snow remover 10 is scraped in behind the auger 34. The snow scraped in by the auger 34 is propelled upward by the blower 36 and expelled in the desired direction via the shooter 38. The orientation of the distal end (outlet) of the shooter 38 is configured so as to be adjustable by operating the shooter direction control lever 56. A cylinder 64 (shown in FIG. 2) can be expanded and contracted to adjust the angle of the frame of the snow remover 10 supported on the crawlers 16L and 16R by operating the auger height control lever 54, whereby the height of the auger 34 from the ground surface can be adjusted. Thus, the engine 22 is mounted on the snow remover 10 having the snow removal mechanism 30 and the travel mechanism 42 such that at least one, often both, of the snow removal mechanism 30 and travel mechanism 42 is driven by the engine 22 in response to an instruction of the operator.

Figure 3:
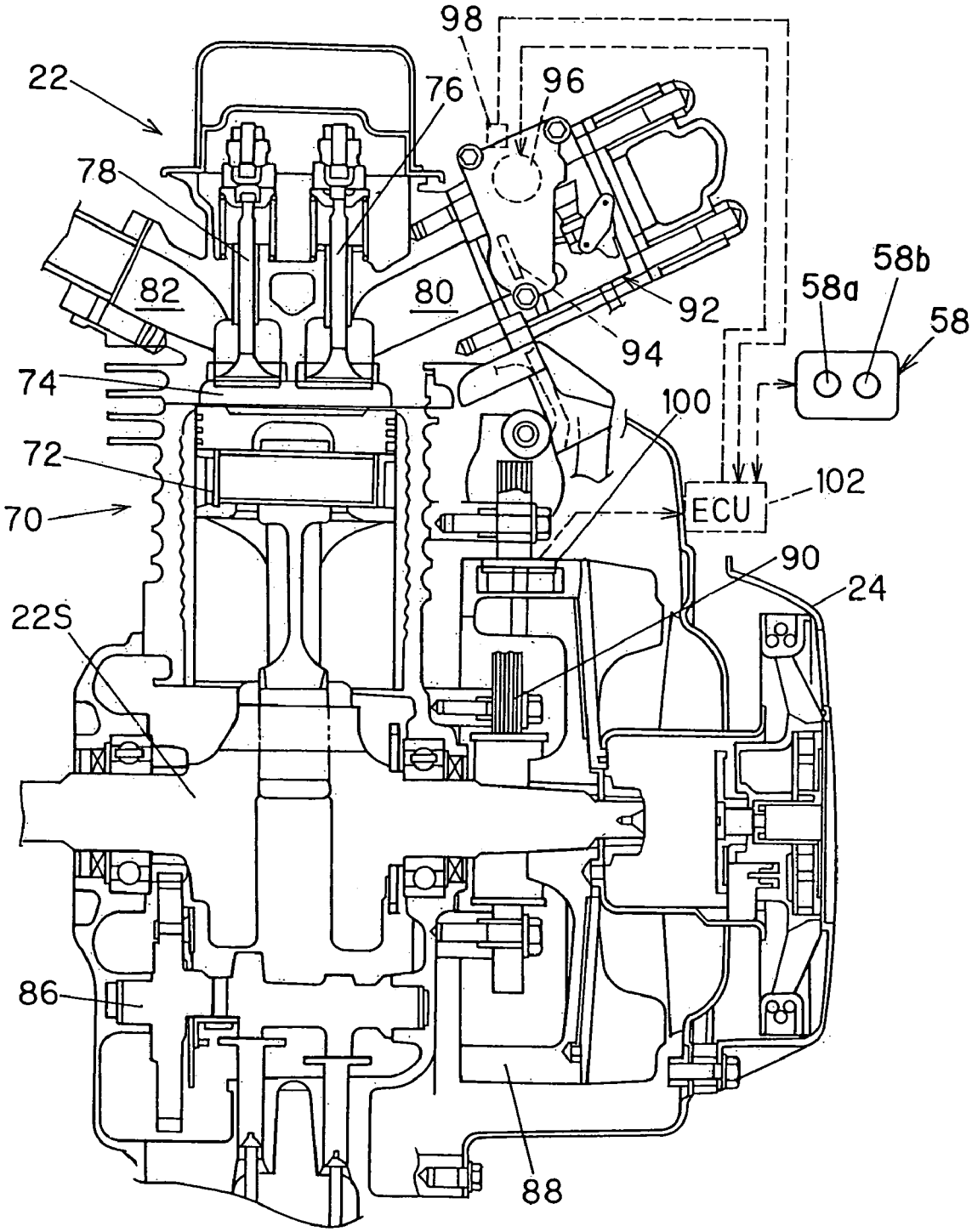
FIG. 3 is an explanatory cross-sectional view of an internal combustion engine shown in FIG. 1.

FIG. 3 is an explanatory cross-sectional view of the engine 22.

The engine 22 has a single cylinder 70, and a piston 72 is reciprocatingly accommodated therein. A combustion chamber 74 is formed between the head of the piston 72 and the cylinder wall, an intake valve 76 and an exhaust valve 78 are disposed on the combustion chamber 74, and the space between the combustion chamber 74 and an intake pipe 80 or an exhaust pipe 82 is opened or closed. The engine 22 is specifically an air-cooled four-cycle single-cylinder OHV engine with a 163 cc displacement.

The piston 72 is linked to the crankshaft 22S, and the crankshaft 22S is linked to a camshaft 86 via a gear. A flywheel 88 is attached to one end of the crankshaft 22S, and the recoil starter 24 is attached to the distal end side of the flywheel 88.

A power-generating coil (alternator) 90 is disposed on the inner side of the flywheel 88 to generate an alternating current. The alternating current generated by the power-generating coil 90 is converted to a direct current via a processing circuit (not shown), and is then supplied as the operating power source to an ECU (Electronic Control Unit; described later), an ignition circuit (not shown), or the like.

Also, a throttle body 92 is disposed upstream of the intake pipe 80. The throttle valve (now assigned with reference numeral 94) is accommodated in the throttle body 92, and the throttle valve 94 is connected to an electric motor 96 (actuator; specifically, a stepping motor) via a throttle axle and a reduction gear mechanism (neither shown). A carburetor assembly (not shown) is provided upstream of the throttle valve 94 in the throttle body 92. The carburetor assembly is connected to a fuel tank (not shown) and is used to spray gasoline fuel into the suctioned air in response to the position of the throttle valve 94 to form an air-fuel mixture. The air-fuel mixture thus formed is suctioned into the combustion chamber 74 of the cylinder 70 through the throttle valve 94, the intake pipe 80, and the intake valve 76.

A throttle position sensor 98 is disposed near the electric motor 96, and the sensor outputs a signal corresponding to the position or opening θTH (hereinbelow referred to as "throttle position") of the throttle valve 94. A crank angle sensor 100 comprising an electromagnetic pickup is disposed near the flywheel 88, and the sensor outputs a pulse signal for each specific crank angle.

The outputs from the throttle position sensor 98 and crank angle sensor 100 are inputted to the ECU (now assigned with reference numeral 102). The ECU 102 has a microcomputer with a CPU, ROM, RAM, and counter, and is disposed at a suitable location in the snow remover 10.

The ECU 102 counts output pulses from the crank angle sensor 100 to detect or determine the engine speed NE. The ECU 102 calculates the current supply command value of the electric motor 96 so that the engine speed NE becomes equal to the predetermined desired speed NED on the basis of the detected engine speed NE and throttle position θTH, and also outputs the calculated command value to the electric motor 96 to control its operation.

Thus, the snow remover 10 according to this embodiment is configured so that the throttle valve 94 is opened and closed by the electronically controlled throttle device (electronic governor) that has the throttle body 92, the ECU 102, and the various sensors, and the engine speed NE is controlled so as to reach the desired speed NED by controlling the amount of air intake in the engine 22.

The ECU 102 determines the output condition of the engine 22 on the basis of the detected engine speed NE and throttle position θTH, and turns the rated-power display light 58*a* and overpower display light 58*b* of the display device 58 on and off accordingly.

Figure 4:
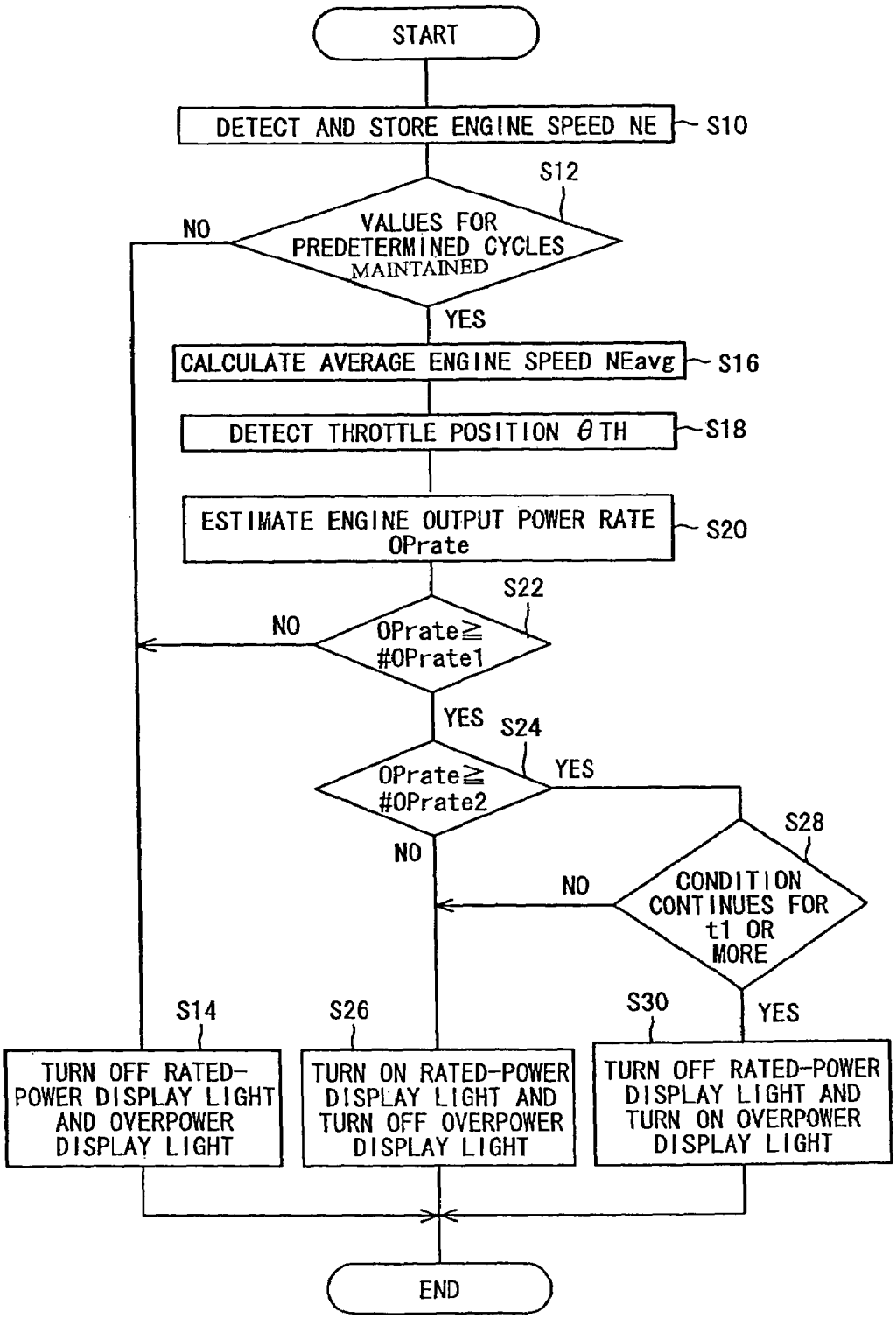
FIG. 4 is a flowchart showing the operation of the engine output condition informing system for a snow remover according to the embodiment.

Next, the operation of the engine output condition informing system for a snow remover according to this embodiment will be described with reference to FIG. 4 and onward. FIG. 4 is a flowchart showing the operation. The program shown is executed at specific intervals (for example, 20 msec) in the ECU 102.

First, in S10, the engine speedNE is detected and the detected engine speed NE is successively stored in the RAM of the ECU 102. Next, the program advances to S12, and it is determined whether the detected values of the engine speed NE for the duration of a predetermined number of cycles (for example, 10 cycles) is maintained. When the determination is negative in S12, the program advances to S14 and the rated-power display light 58*a* and overpower display light 58*b* are turned off. When the determination is positive in S12, the program advances to S16 and the average engine speedNEavg is calculated. The average engine speed NEavg is the average value of the engine speed NE maintained for the duration of the predetermined number of cycles.

Next, the program advances to S18, the current value of the throttle position θTH is detected, the program further advances to S20, and the output power rate OPrate of the engine 22 is estimated. The engine output power rate OPrate is a value (parameter) that indicates the engine load, and is estimated based on the average engine speed NEavg (roughly equal to the engine speed NE) and the throttle position θTH.

Figure 5:
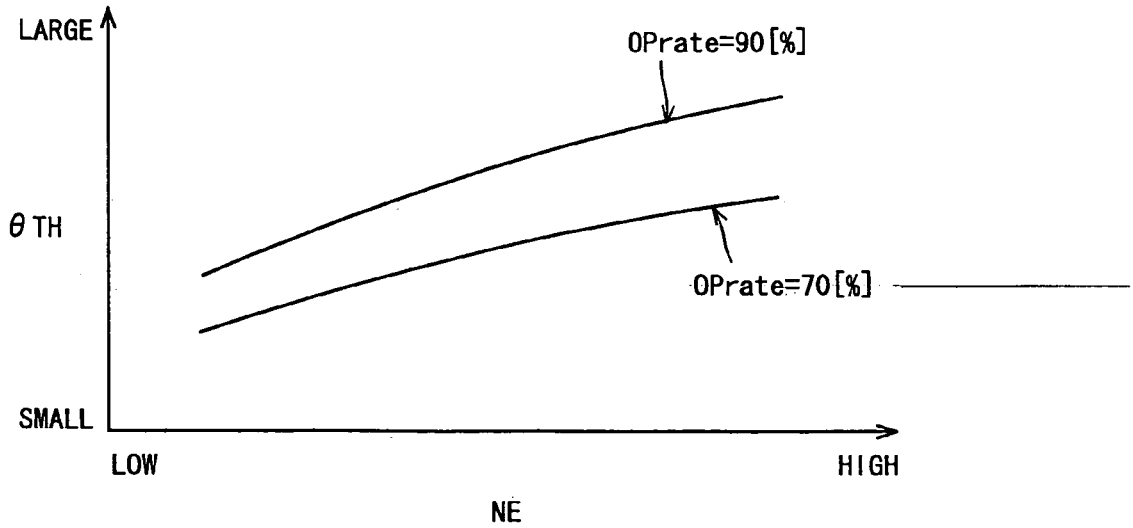
FIG. 5 is a graph showing the characteristics of the engine speed NE relative to the throttle position θTH separately for output power rate of the engine.

To specifically describe the manner in which the engine output power rate OPrate is estimated, the characteristics of the throttle position θTH corresponding to the engine speed NE vary with the output power rate of the engine 22, as shown in FIG. 5. This is because when the load acting on the snow removal mechanism 30 or travel mechanism 42 (specifically, the load on the engine 22) increases or decreases and error or deviations occur in the engine speed NE and the desired speed NED, the ECU 102 drives the electric motor 96 and adjusts the throttle position θTH (specifically, varies the engine output power rate OPrate and adjusts the engine output power OP) to maintain the desired speed NED.

Accordingly, the corresponding engine output power rate OPrate can be estimated from the relationship between the engine speed NE (more specifically average engine speed NEavg) and the throttle position θTH. In view of this, in this embodiment, the relationship between the throttle position θTH and the engine output power rate OPrate for each engine speed is mapped out in advance through experimentation, and the output power rate OPrate is estimated by retrieving the map on the basis of the detected engine speed NE (i.e., average engine speed NEavg) and throttle position θTH.

Continuing the description of the flowchart in FIG. 4, the program then advances to S22, and it is determined whether the engine output power rate OPrate exceeds a first predetermined value #OPrate1. The first predetermined value #OPrate1 is specifically set to 70%, as shown in FIG. 6.

Figure 6:
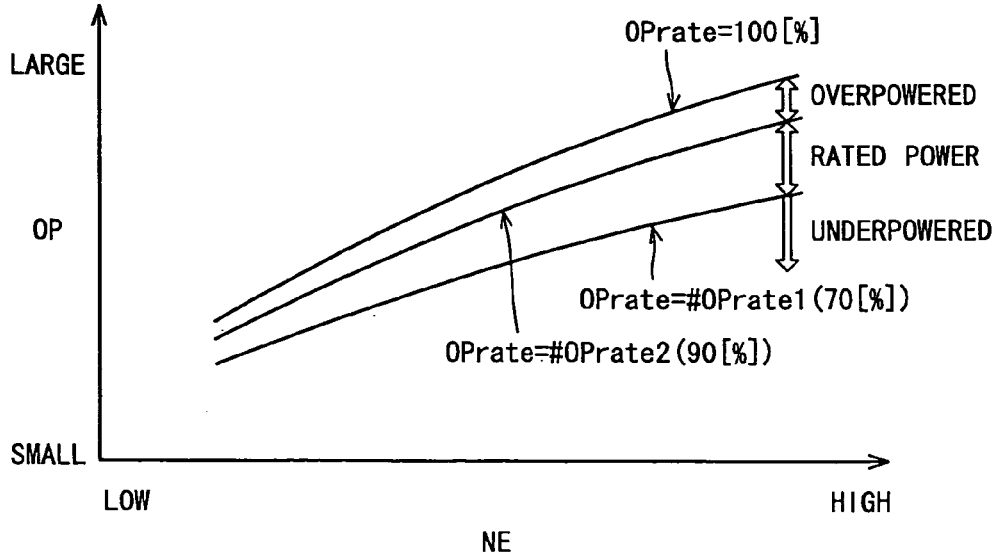
FIG. 6 is a graph showing the characteristics of the engine speed NE relative to the engine output power.

When the determination is negative in S22, specifically, when the engine output power rate OPrate is less than 70%, the output power condition of the engine 22 is determined to be underpowered or low as shown in FIG. 6, the program advances to S14, and the rated-power display light 58*a* and overpower display light 58*b* are turned off. Specifically, when the estimated engine output power rate OPrate is less than the first predetermined value #OPrate1 (70%), the operator is informed by the turning off of the rated-power display light 58*a* and the overpower display light 58*b* that the output power condition of the engine 22 is low and that the load acting on the snow removal mechanism 30 or travel mechanism 42 may be increased.

When the determination is positive in S22, the program advances to S24, and it is determined whether the engine output power rate OPrate is equal to or greater than a second predetermined value #OPrate2 that is set to a higher value than the first predetermined value #OPrate1. The second predetermined value #OPrate2 is specifically set to 90%, as shown in FIG. 6.

When the determination is negative in S24, specifically, when the engine output power rate OPrate is 70% or greater and less than 90%, the output power condition of the engine 22 is determined to be within the rated output power, as shown in FIG. 6, the program advances to S26, the rated-power display light 58*a* is turned on, and the overpower display light 58*b* is turned off.

Specifically, when the estimated engine output power rate OPrate is equal to or greater than the first predetermined value #OPrate1 (70%) and is less than the second predetermined value #OPrate2 (90%), the rated-power display light 58*a* is turned on and the overpower display light 58*b* is turned off to inform the operator that the output power condition of the engine 22 is within the rated power and that there is no danger that continuing the current operation will damage the power train of the engine 22 or of the snow removal mechanism 30 and travel mechanism 42.

When the determination is positive in S24, specifically, when the engine output power rate OPrate is equal to or greater than 90%, the program then advances to S28, and it is determined whether the condition that the engine output power rate OPrate is equal to or greater than the second predetermined value #OPrate2 continues for the duration of a predetermined time period t1 (for example, 1 sec) or more. This determination is performed by starting a counter with a separate program (not shown) when the determination is positive in S24 and confirming whether the counter value has reached the first predetermined time period t1.

When the determination is positive in S28, the output power condition of the engine 22 is determined to be in an overpowered state, the program advances to S30, the rated-power display light 58*a* is turned off, and the overpower display light 58*b* is turned on.

Specifically, when the estimated engine output power rate OPrate is equal to or greater than the second predetermined value #OPrate2 (90%) (specifically, when the engine output power rate OPrate continues to be equal to or greater than the second predetermined value #OPrate2 for the duration of the predetermined time period t1), the rated-power display light 58*a* is turned off and the overpower display light 58*b* is turned on to inform the operator that the output power condition of the engine 22 is in an overpowered state and that there is a danger that continuing the current operation may damage the power train of the engine 22 or of the snow removal mechanism 30 and travel mechanism 42. In other words, the operator is urged to operate the speed control lever 52 or the auger height control lever 54 to reduce the load acting on the snow removal mechanism 30 or travel mechanism 42, and to thereby reduce the engine load.

When the determination is negative in S28, the program advances to S26 and the rated output state informing continues. This is to prevent temporary increases in the engine output power rate OPrate (accidental increases resulting from fuel buildup or the like) from being mistakenly determined as overpowering, and to prevent needless informs or alarms to the operator.

Thus, in this embodiment, the configuration is such that the engine speed NE and the throttle position θTH are detected, the output power rate OPrate of the engine 22 is estimated based on the detected engine speed NE and throttle position θTH, the output power condition of the engine 22 is determined based on the estimated output power rate OPrate, and the operator is informed of the determined output power condition by the display device 58. Specifically, the estimated engine output power rate OPrate is compared with the first predetermined value #OPrate1 and the second predetermined value #OPrate2; the output power condition of the engine 22 is determined to be either underpowered (low), within the rated output power, or in an overpowered state on the basis of the results of this comparison; and the operator is informed of the output power condition of the engine 22 by turning on and off the display device 58 according to the results of this determination. Therefore, the output power condition of the engine 22 can be accurately determined and the operator informed with a simple configuration, whereby the burden on the operator can be lightened. Also, it is possible to minimize situations in which the output power condition of the engine 22 is overpowered and the power train of the engine 22 or of the snow removal mechanism 30 and travel mechanism 42 is damaged, as well as situations in which the output power condition of the engine 22 becomes underpowered, the snow remover 10 is unable to perform, and the operating efficiency decreases.

More specifically, the output power condition of the engine 22 is determined to be underpowered when the estimated engine output power rate OPrate is less than the first predetermined value #OPrate1, the output power condition of the engine 22 is determined to be within the rated output power when the estimated output power rate OPrate is equal to or greater than the first predetermined value #OPrate1 and is less than the second predetermined value #OPrate2 that is set to a greater value than the first predetermined value #OPrate1, the output power condition of the engine 22 is determined to be in an overpowered state when the estimated output power rate is equal to or greater than the second predetermined value #OPrate2, and the operator is informed whether the output power condition of the engine 22 is underpowered, within the rated output power, or in an overpowered state by turning on and off the rated-power display light 58*a* and overpower display light 58*b*. Therefore, the operator can be more reliably informed of the output power condition of the engine 22, whereby the burden on the operator can be further lightened and damage to the power train of the engine 22 as well as reductions in operating efficiency can be effectively inhibited.

In a snow remover 10 equipped with the electronically controlled throttle device (electronic governor), as in the engine 22 according to the present embodiment, the effect of simplifying the device can be made more prominent, since the output power rate OPrate can be estimated from the existing output values of the throttle position sensor 98 and the crank angle sensor 100.

Thus, the embodiment is configured to have a system for informing output condition of an internal combustion engine 22 mounted on a snow remover 10 having a snow removal mechanism 30 and a travel mechanism 42 such that at least one of the snow removal mechanism and travel mechanism is driven by the engine in response to an instruction of an operator, comprising: an engine speed sensor (crank angle sensor) 100 detecting speed NE of the engine 22; a throttle position sensor 98 detecting position θTH of a throttle valve 94; an engine output power rate estimator (ECU 102, S20) estimating an engine output power rate OPrate based on the detected speed of the engine and position of the throttle valve; an engine output condition determiner (ECU 102, S22, S24) determining output condition of the engine based on the estimated engine output power rate; and an informing device (display device 58, ECU 102, S14, S26, S30) informing the determined output condition of the engine to the operator.

In the system, wherein the engine output condition determiner determines the output condition of the engine by comparing the estimated engine output power rate OPrate with a plurality of predetermined values #OPrate1, #OPrate2. More specifically, the engine output condition determiner determines that the output condition of the engine is within rated output power when the estimated engine output power rate exceeds a first predetermined value #OPrate1, but is less than a second predetermined value #OPrate 2 set higher than the first predetermined value.

And, the engine output condition determiner determines that the output condition of the engine is underpowered when the estimated engine output power rate is less than the first predetermined value #OPrate1, while determines that the output condition of the engine is overpowered when the estimated engine output power rate exceeds the second predetermined value #OPrate2.

In the above descriptions, although the first predetermined value #OPrate1, the second predetermined value #OPrate2, and other such numeric values are specifically indicated, these numeric values are obviously not limited to the values given.

Further, although the rated-power display light 58*a* is configured to be turned off along with the overpower display light 58*b* when the output power rate OPrate is less than the first predetermined value #OPrate1 and the condition is determined to be underpowered, a display light that turns on for an underpowered state may also be provided.

Furthermore, although the operator is informed of the output condition by a visual display, an audible sound may also be used.

Furthermore, although a stepping motor is used as an actuator for opening and closing the throttle valve 94, a DC motor, a rotary solenoid, or another such actuator may also be used.

Japanese Patent Application No. 2004-007381 filed on Jan. 14, 2004, is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A system for indicating output condition of an internal combustion engine mounted on a snow remover having a snow removal mechanism and a travel mechanism such that at least one of the snow removal mechanism and travel mechanism is driven by the engine in response to an instruction of an operator, comprising:

an engine speed sensor detecting speed of the engine;

a throttle position sensor detecting position of a throttle valve of the engine;

an engine output power rate estimator estimating an engine output power rate based on the detected speed of the engine and position of the throttle valve;

an engine output condition determiner determining output condition of the engine based on the estimated engine output power rate; and an indicating device indicating the determined output condition of the engine to the operator.

2. The system according to claim 1, wherein the engine output condition determiner determines the output condition of the engine by comparing the estimated engine output power rate with a plurality of predetermined values.

3. The system according to claim 2, wherein the engine output condition determiner determines that the output condition of the engine is within rated output power when the estimated engine output power rate exceeds a first predetermined value, but is less than a second predetermined value set higher than the first predetermined value.

4. The system according to claim 3, wherein the engine output condition determiner determines that the output condition of the engine is underpowered when the estimated engine output power rate is less than the first predetermined value, and determines that the output condition of the engine is overpowered when the estimated engine output power rate exceeds the second predetermined value.

5. A method of indicating output condition of an internal combustion engine mounted on a snow remover having a snow removal mechanism and a travel mechanism such that at least one of the snow removal mechanism and travel mechanism is driven by the engine in response to an instruction of an operator, comprising the steps of:

detecting speed of the engine;

detecting position of a throttle valve of the engine;

estimating an engine output power rate based on the detected speed of the engine and position of the throttle valve;

determining output condition of the engine based on the estimated engine output power rate; and indicating the determined output condition of the engine to the operator.

6. The method according to claim 5, wherein the step of engine output condition determining determines the output condition of the engine by comparing the estimated engine output power rate with a plurality of predetermined values.

7. The method according to claim 6, wherein the step of engine output condition determining determines that the output condition of the engine is within rated output power when the estimated engine output power rate exceeds a first predetermined value, but is less than a second predetermined value set higher than the first predetermined value.

8. The method according to claim 7, wherein the step of engine output condition determining determines that the output condition of the engine is underpowered when the estimated engine output power rate is less than the first predetermined value, and determines that the output condition of the engine is overpowered when the estimated engine output power rate exceeds the second predetermined value.

* * * * *